United States Patent [19]

Hashio et al.

[11] 4,313,487

[45] Feb. 2, 1982

[54] APPARATUS FOR CHANGING THE WIDTH OF A CAST PIECE

[75] Inventors: Moriki Hashio; Tomohiko Kimura, both of Ibaragi, Japan

[73] Assignee: Sumitomo Kinzoku Kogyo Kabushiki Kaisha, Osaka, Japan

[21] Appl. No.: 97,601

[22] Filed: Nov. 27, 1979

Related U.S. Application Data

[62] Division of Ser. No. 931, Jan. 4, 1979.

[51] Int. Cl.[3] ..... B22D 11/04

[52] U.S. Cl. ..... 164/436; 164/412

[58] Field of Search ..... 164/436, 425, 445, 412

[56] References Cited

U.S. PATENT DOCUMENTS 3,612,150 10/1971 Rossi ..... 164/436 X

FOREIGN PATENT DOCUMENTS 1350780 12/1963 France ..... 249/106

46-39225 11/1971 Japan ..... 164/426

51-17941 6/1976 Japan ..... 164/445

*Primary Examiner*—Robert D. Baldwin

*Attorney, Agent, or Firm*—Ladas & Parry

[57] ABSTRACT

Herein disclosed is a method and apparatus for changing the width of a cast piece during continuous operation. The method comprises stopping pouring a molten metal into a mold, inserting a frame including a pair of opposite side plate members into the mold so that the lower ends of the members are dipped in the molten metal, pouring the molten metal into a cavity defined by said frame, and withdrawing the cast piece together with said frame to obtain a cast piece having a desired width.

14 Claims, 16 Drawing Figures

APPARATUS FOR CHANGING THE WIDTH OF A CAST PIECE

CROSS-REFERENCE TO RELATED APPLICATION

This is a divisional of co-pending application Ser. No. 000,931 filed Jan. 4, 1979.

BACKGROUND OF THE INVENTION

The present invention relates to a continuous casting technology, particularly to apparatus for changing the width of a cast piece or strand in continuous casting operation.

Various kinds of variable width casting molds have been recently developed for producing cast pieces having different widths from one charge of a molten metal. Such molds are usually formed of a pair of spaced apart parallel long copper side members and a pair of spaced apart, parallel short copper side members which are movable along the long side members. The long and movable short side members of the mold which are water-cooled defines a cavity having a certain size. The width of the cavity corresponding to a spacing between movable side members may vary depending upon the width of the finished product required.

In the continuous casting operation, a molten metal is gravity poured into the cavity of the mold and partly solidified in the form of shell by being in contact with the water-cooled mold. A cast piece or strand is continuously withdrawn from the bottom of the mold.

When it is desired to change the size or width of the cast piece, the pouring of the molten metal into the mold is stopped; the molten metal as poured into the mold is withdrawn as a cast piece; thereafter one or both of the short side members are moved; a dummy bar corresponding to a changed width is positioned at the bottom of the mold; the molten steel is poured into the mold; and a cast piece with a new and changed width is withdrawn.

Accordingly, it has disadvantages that a casting operation must be stopped completely each time the width of a casting is changed; that it takes a considerable time before the casting operation is resumed; and that the productivity of the continuous casting operation is thus largely lowered.

Many efforts have been made for developing a method and apparatus for changing the width of the cast piece and withdrawing the cast piece without involving discontinuation of cast piece due to the "break-out".

Japanese Patent Publications Nos. 46-39225, 47-25572 and 53-45781 disclose such methods and apparatuses for effectively overcoming the above-mentioned disadvantages which have been encountered in the prior art. According to Japanese Patent Publication No. 46-39225, there are provided a pair of interconnecting upper and lower solid blocks having different widths depending upon the desired width of the cast piece. In order to change the width of the cast piece, the pouring of a molten metal into a mold is stopped. The upper and lower interconnecting blocks which have been combined each other are inserted into the mold for interconnecting the lower and upper cast piece having different widths. The blocks disclosed herein has disadvantages that they require high cost for fabrication and are cumbersome to handle since they are heavy weighted.

The Japanese Patent Publication No. 47-25572 discloses an improved adjustable width continuous casting mold including upper and lower slidable plate members. According to this invention, the existing adjustable width casting mold and the oscillation mechanism for the same must be replaced, resulting in high cost of installation.

The Japanese Patent Publication No. 53-45781 discloses a method of enlarging the width of a cast piece comprising stopping the pouring of a molten metal into a mold; positioning a supporting plate at the bottom of the mold; and then moving a side wall of the mold. This method can not be performed for decreasing the width of a cast piece. There is a fear that the solidified shell will break since it is self-erecting and that the "break-out" of the cast piece will occur.

It is therefore an object of the invention to provide apparatus for effectively overcoming the above-mentioned disadvantages which have been encountered in the prior art.

It is another object of the invention to provide apparatus for enlarging and decreasing the width of a cast piece during the continuous casting operation with a minimal labor and time.

It is a further object of the invention to provide apparatus for changing the width of a cast piece without involving leaks of molten metal or breaking out of the cast piece.

It is a further object of the invention to provide apparatus for changing the width of a cast piece with a minimal length of the cast piece to be discorded where different width cast piece are connected each other.

SUMMARY OF THE INVENTION

The present invention comtemplates to provide a method of changing the width of cast piece formed in a continuous metal casting operation using an adjustable width casting mold comprising a pair of spaced apart longitudinal walls and a pair of spaced apart transverse walls in contact therewith which are movable along said longitudinal walls, the improvement comprising stopping the pouring of a molten metal into said mold; stopping the withdrawal of the cast piece from said mold; inserting into said mold from the upper end thereof a frame means including a pair of opposite side plate members so that the lower ends of said plate members are dipped into the molten metal in the mold, said plate members having vertically extending upper portions which are spaced apart each other at a distance substantially equal to a desired width to thereby define a cavity together with said longitudinal walls pouring the molten metal into said spacing; beginning the withdrawal of the cast piece having a changed width together with said frame means; and moving said movable walls of said mold to contact with the outer surfaces of said upper portions of said opposite side plate members.

Other objects of this invention will appear in the following description and appended claims, reference being had to the accompanying drawings forming a part of this specification wherein like reference characters designate corresponding parts in the several views.

DESCRIPTION OF PREFERRED EMBODIMENTS

A method of reducing the width of a casting or cast piece in the continuous casting operation will be first referred to in conjunction with FIGS. 1 through 6.

Figure 1:
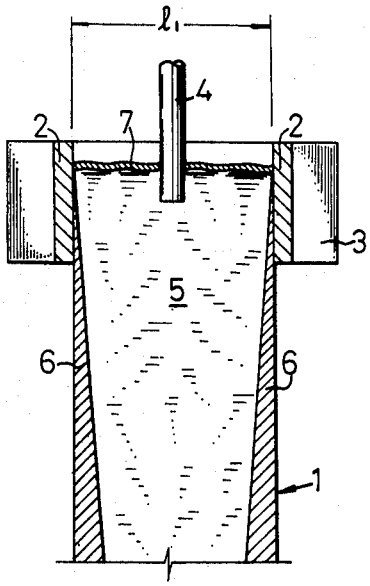
FIGS. 1 through 6 are schematic sectional views showing a way of changing the width of a cast piece to smaller size, according to the present invention.
Figure 2:
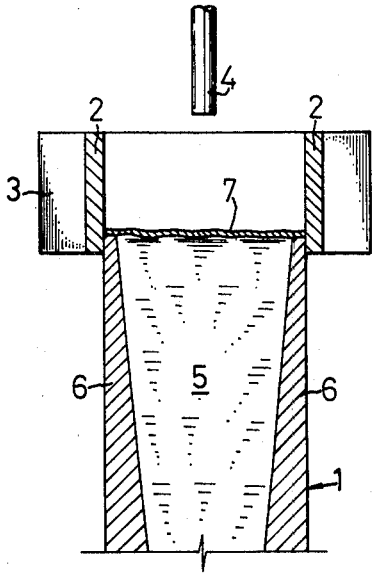

FIG. 1 shows a casting mold by which a casting 1 having a width is produced in the continuous casting operation, wherein shown at 2 are movable walls of the mold, at 3 fixed walls of the mold, at 4 a nozzle for pouring molten steel into the mold, which is partly dipped in molten steel, at 5 molten steel; at 6 a solidified shell and at 7 powdered flux on the surface of molten steel for thermal insulation.

In order to produce cast piece 1 of a reduced width $l_2'$ the pouring of molten steel into the mold 2 and 3 is stopped, and the nozzles 4 is lifted above the surface of molten steel in the mold. The withdrawing of the cast piece from the mold 2 and 3 by means of pinch rollers (not shown) is continued. When the molten steel surface is lowered to a level of 100 to 200 mm above the bottom of the mold 2 and 3, the withdrawing of casting from the mold 2 and 3 is stopped.

Figure 3:
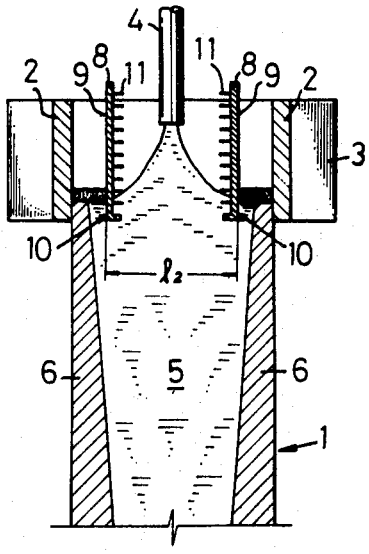

FIG. 3 shows such condition of the casting in the mold. In this stage, the growth of solidified shell 6 of the cast piece to a greater extent is recognized, and the top surface of the cast piece 1 is maintained in a molten state by virtue of the thermally insulating effect of powdered flux 7.

Under such condition, a frame as shown in FIG. 3 is inserted into the mold 2 and 3. More in detail, a pair of side plate members 8 are inserted into a cavity defined by opposing movable walls 2 and fixed walls 3 and the insertion of the side plate members is accomplished in parallel to the movable walls of the mold, until the lower ends of the side plates are dipped in the molten steel 5 of the cast piece 1. The side plate members 8 have vertical portions 9 on the upper outer surface thereof, respectively, which portions are parallel to respective movable walls 2, so that the inner surfaces of the movable walls are in contact with the upper outer surfaces of respective side plate members when the movable walls are shifted to the side plate members, respectively, in a manner described below. Vertical portions 9 are spaced apart each other a distance substantially equal to the width $l_2$ of the cast piece 1 to be changed. The lower ends of side plate members are located at a level of 100 to 200 mm below the molten steel surface of the existing cast piece 1.

The side plate members 8 shown in the drawings are respectively made of a flat plate of 6 to 10 mm in thickness and have anchor elements 10 at the lower ends thereof, respectively, so as to ensure the coupling of the cast piece being produced to the existing cast piece and locking projections 11 on the opposite inner surfaces thereof. The reason why the frame including opposite side plate members is inserted when the molten steel surface in the mold is at a level of 100 to 200 mm above the bottom of the mold is firstly to precent leak of molten steel, and secondly to insure the rapid solidification of molten steel even in the event that leak of molten steel arises at the interstice between side plate members 8 and fixed walls 3 of the mold. In the actual operation, it is preferable that a cooling agent such as steel chips, nail scraps, etc., be scattered on the surface of molten steel between the side plate members of the frame and the movable walls 2 of the mold.

Figure 11:
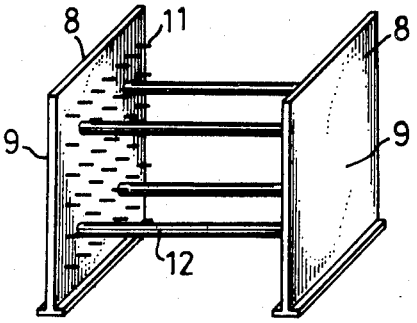
FIG. 11 is a perspective view showing side plate members used for reducing the width of a cast piece.

It is also preferable that the opposite side plate members 8 of the frame be coupled together by such as tie rods 12 shown in FIG. 11, or said plates to form a framework, for ease of insertion.

Figure 4:
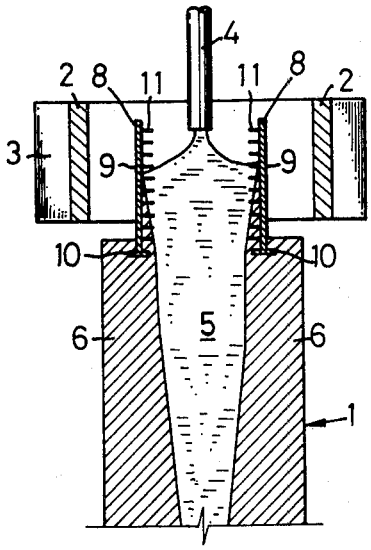
Figure 5:
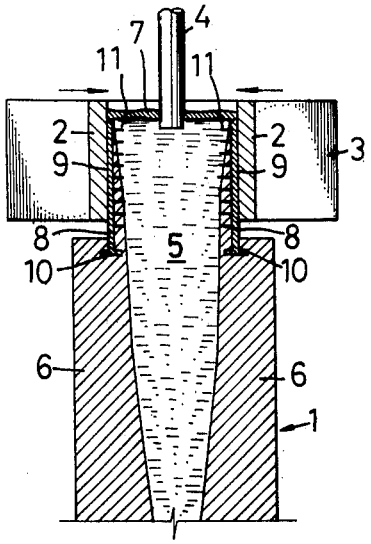

After the insertion of the frame into the mold, the nozzle 4 is moved downward to be located within a cavity defined by opposite side members 8 and fixed walls 3 and the molten steel is gravity poured through the nozzle 4 into the cavity as seen in FIG. 3. As the side members 8 are anchored at the lower ends thereof by the solidified shell 6 of the cast piece 1, the existing cast piece is pulled downward at a rate of 0.2 to 0.3 m/minute, as shown in FIG. 4, until the top shoulder portion of the cast piece emerges from the lower edges of movable walls 2 of the mold.

Movable walls 2 are then moved horizontally in a direction to reduce the switch $l_1$, of the mold to the width $l_2$, namely toward the frame to contact with the vertical upper portions 9 of frame 8, whereby the width $l_1$, of the mold is reduced to width $l_2$.

The movable walls, in general are moved by remote control using hydraulic pressure or by a motor. In this embodiment, it is preferable that, for example, a synchromous mechanism be provided, so that an operator may recognize the movement by a given length, of the movable walls, or the movement or stopping of the movable walls may be automatically accomplished by presetting a length of movement.

The speed of movement of the movable walls 2 is determined so that the movable walls 2 complete its movement while one half or one third of side plate members 8 of the frame as viewed from the top thereof is lodged in the mold.

Figure 6:
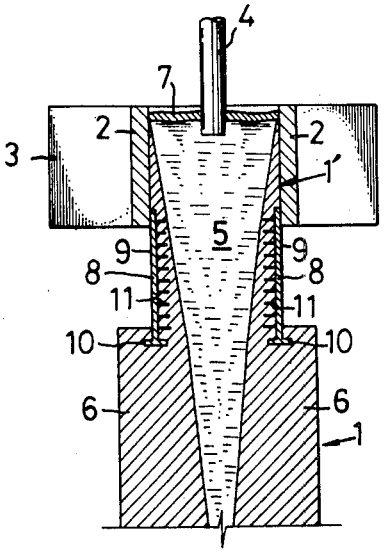

After reduction in the width of the mold is completed, side plate members 8 are withdrawn downward, together with the cast piece 1, from the lower edge of the mold as shown in FIG. 6 on the continuous casting basis as usual. A portion of cast piece to which the side plate members are secured is cut off by a cutter on the exit side of the pinch rollers (not shown). According to the method of the present invention, the portion of cast piece to be discarded is limited to only that portion to which the side plate members are secured. The length of the cast piece 1 to be cut off is remarkably reduced, as compared with that in the prior art.

The method of increasing the width of a cast piece 1 in the continuous casting operation will be explained with reference to FIGS. 7 through 10.

The procedures for increasing the width of cast piece 1 from a width 1 to a width 3 are the same as those for reducing the width of the mold as described with reference to FIGS. 1 through 6.

The pouring of the molten steel into the mold is stopped, then the nozzle 4 is lifted, and the withdrawal of the cast piece 1 from the mold is continued until the molten metal surface in the mold is lowered to a level of 100 to 200 mm as measured from the lower edge of the mold.

Figure 7:
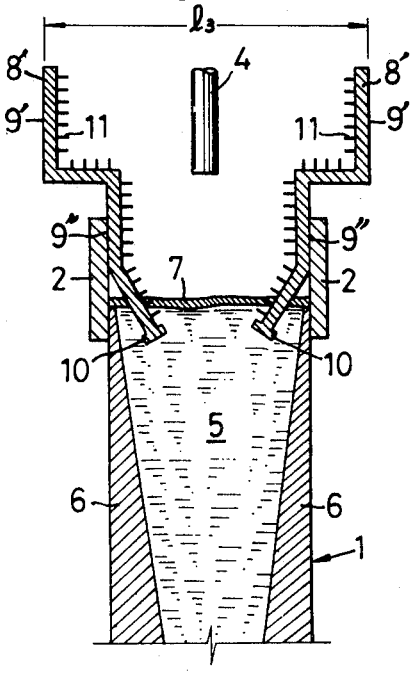
FIGS. 7 through 10 are schematic sectional views showing a way of changing the width of a cast piece to an enlarged size, according to the present invention.

With this situation maintained intact, a frame is set in the mold as seen in FIG. 7. Also, in this case, the side plate members 8 forming the frame comprises the upper vertical portions 9', which are spaced apart from each other at a distance substantially equal to the width $l_3$ of a cast piece 1 to be produced and lower vertical portions 9'' which are in an opposed relation to the inner surfaces of movable walls 2. Lower vertical portions 9'' of the side plate members 8 are convergent toward the lower end thereof, providing a funnel-shaped cross section. The convergent portion is dipped in the molten metal 5 of cast piece 1 in the mold, with the lower end thereof located at a level of 100 to 200 mm below the molten metal surface.

The procedures for increasing the width of the mold are identical with those for reducing the width thereof only except that the side plate members in the forth of a bent or curved shape are used, but the former is the same as the latter in the points that a spacing between the upper portions of the opposite side members is substantially equal to the width of a cast piece to be required, and the lower ends of the side members 8 are dipped in the molten metal 5 of existing cast piece 1.

Figure 15:
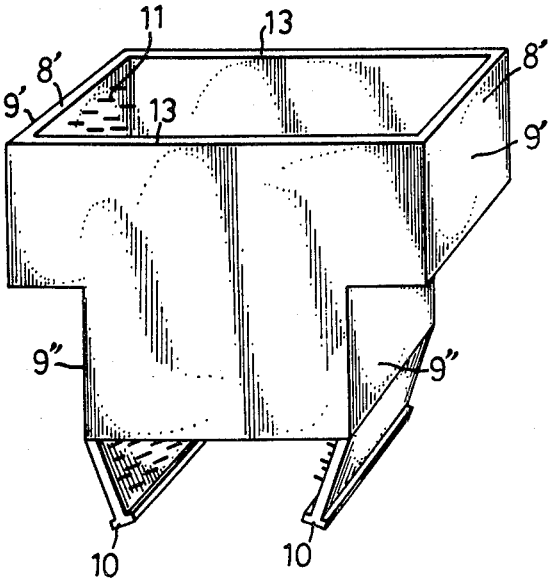
FIG. 15 is a perspective view of frame used for producing a cast piece having a increased width.

FIG. 15 shows an example of side plate members 8' which are coupled together by side spacer plates 13 for ease of insertion into the mold. Such side plate members may be made separately from each other. In the latter case, the side plate members are inserted individually into the mold in an opposed relation to the fixed walls of the mold and then fixed therein to form a temporary mold.

Figure 8:
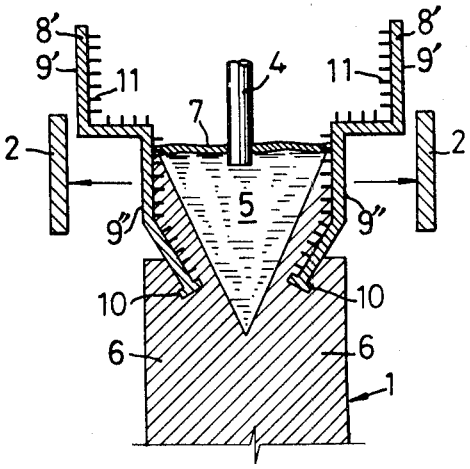
Figure 9:
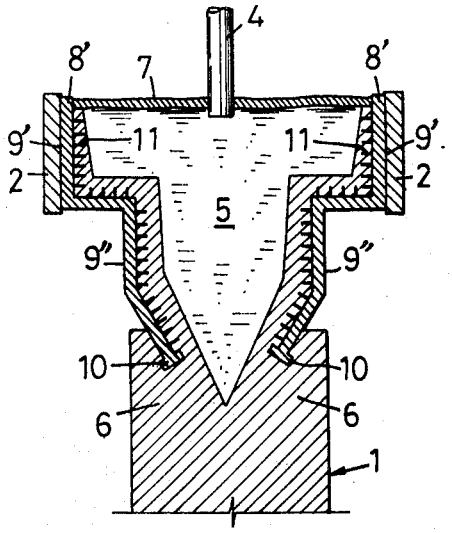
Figure 10:
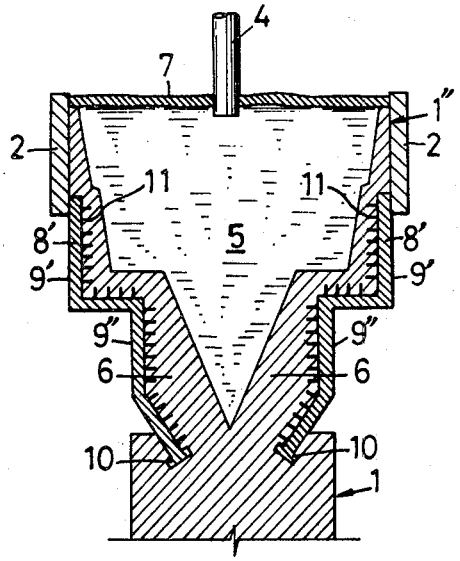

After the side plate members forming a frame has been set in the mold, the nozzle 4 is moved downward to position within the mold, as seen in FIG. 8 and a molten steel is then poured into a cavity defined by the opposite side members 8'. When the side plate members 8' are anchored as at 10 at the lower ends thereof to solidified shell 6 of cast piece 1, the withdrawal of cast piece 1 is recommenced.

Then, movable walls 2 of the mold are moved horizontally outwards, so as to increase width $l_1$ to width $l_3$. In this instance, the movable walls 2 must complete its movement before the upper enlarged portion 9' of the side plate members 8' moving downward, together with cast piece 1, reaches the top edges of movable walls 2.

Thus, the width of the mold is increased. The side plate members 8' are pulled downward together with cast piece 1. The portion of the cast piece 1 to which the side plate members 8' are secured is cut off to remove in such a manner described in the preceding example.

One of the features of the present invention reside in that in changing the width of a cast piece to a desired size during the continuous casting operation, a pair of the opposite side wall members 8' are used for protecting a cast piece in which the enough solidification does not progress from the break-out to make it possible to reliable and easy production of a cast piece of an increase or reduced width. Another feature of the present invention reside in that a duration for which the withdrawal of a cast piece is stopped for increasing or decreasing the width of the mold is greatly shortened to on the order of 30 seconds. According to our experiments, during the continuous casting operation for producing a casting of 1150 mm wide×270 mm thick by continuously pouring a steel consisting of 0.09% of carbon, 0.15% of silicon and 0.61% of manganese into S-type continuous casting equipment at a rate of 0.9 m/minute, the width of the mold was increased to 1350 mm, and a time of stopping of the withdrawal of the casting operation for producing a casting of 1250 mm wide×270 mm thick, the width of the mold was reduced to 1200 mm, and a time of stopping of the withdrawal of the casting for that purpose was 35 seconds. In either case, the changing in a width of the mold to a desired size could be accomplished rapidly without involving the break out of cast piece and leak of the molten steel.

According to the aforementioned method of changing the width of a cast piece, the frame including the opposite side plate members is inserted into the mold after the pouring of the molten metal is stopped.

Alternatively, the frame may be inserted into the mold at a speed equal to the descent speed of the surface level of the molten metal with lower ends of the side plate members being dipped in the molten steel. Then the withdrawal of the cast piece is stopped when the surface level of the molten steel is slightly above the lower end of the mold.

For realizing the method of the present invention easily, rapidly, safely and accurately, respective pairs of side plate members 8 and 8' should preferably meet the below-described requirements, particularly ease of insertion and the utility thereof:

(1) The side plate members should be able to accommodate a large amount of molten steel therein for at least 5 minutes from the charging of molten steel until the movement of movable walls 2 for changing the width of the mold is completed.

(2) Leak of molten steel must not be involved between the fixed walls 3 and the side plate members 8 while the molten steel is retained between side plate members.

(3) The side plate members should be smoothly withdrawn together with the cast piece from the mold to pass through guide rollers in a secondary cooling zone and to be cut off from the cast piece, without causing any trouble with the casting equipment or the cast piece.

(4) For ease of insertion of side plate members into the mold as well as reduction in time required for changing the width, side plate member should preferably be preassembled by means of a known tundish car or the like and placed above a mold, in such a manner that the side plate member assembly may be moved downward to position in place within the mold accurately and easily.

Figure 12:
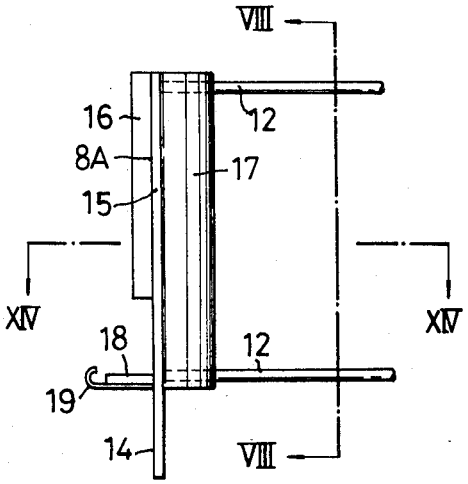
FIG. 12 is a fragmental view of a modified side plate member for use for reducing the width of a cast piece, with the right half portion omitted.
Figure 13:
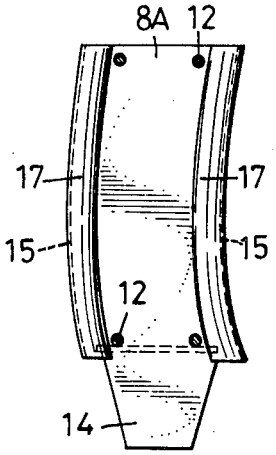
FIG. 13 is a longitudinal cross sectional view taken along the line XIII—XIII in FIG. 12.
Figure 14:
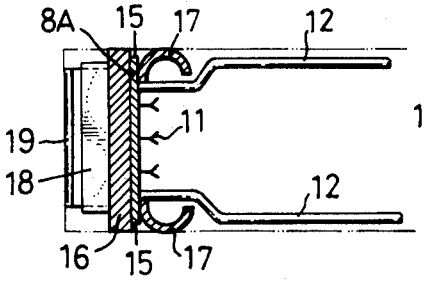
FIG. 14 is a transverse cross sectional view taken along the line XIV—XIV in FIG. 12.
Figure 16:
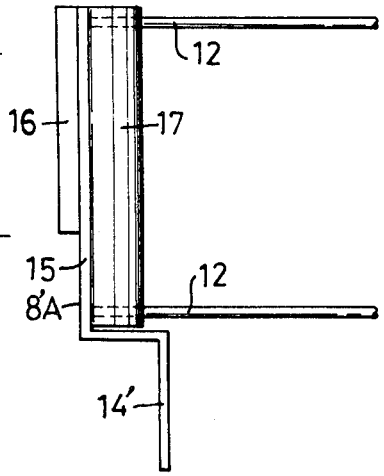
FIG. 16 is a front view of a modified side plate member for use in increasing the width of a cast piece with the right half portion omitted.

FIGS. 12 through 14 show a modification of the frame for producing a cast piece having a reduced width as shown in FIG. 11 and FIG. 16 show a modification of the frame for producing a cast piece having an increased width, as shown in FIG. 15. Two modifications also satisfy the above-described requirements.

Referring to FIGS. 12 through 14, a side plate member 8A for use in producing a cast piece having a reduced width is made of a steel plate of 9 mm in thickness and has a dimension of 650 mm in height and 273 mm in width. The dimension is dependent upon the size and configuration of the mold, which are determined by a configuration of a casting to be required and specifications of the continuous casting equipment. The side plate member 8A has a lower anchor portion 14 covering a range of 100 mm from the lower end thereof, the anchor portion being dipped in the molten steel 5 of cast piece 1 in the mold, width of which remains unchanged, as seen in FIG. 12. The side plate member 8A further has opposite vertical edges 15 curved in conformity with curvatures of front and rear fixed walls 3 of the mold. A strip of a deformable and refractory material, for example an asbestos plate of 25 mm in thickness, is rigidly secured to the upper outer surface of each side plate member 8A. The asbestos plate has parallel vertical opposite edges curved in comformity with a counter or the side plate member 8A and is larger in width to some extent than that of the side plate member 8A, so that when front and rear fixed walls 3 are unfastened, the asbestos plate may be positioned between the curved fixed walls along the curved surfaces thereof at a right angle therewith, thereby providing a sealing function against leak of molten steel from an interstice between the opposite vertical edges 15 of the side plate member 8A and front and rear fixed walls 3. Furthermore, the relationship in width of asbestos plate 16 with the side plate member 8A is such that when movable walls 2 of the mold are moved to given positions for reduction in the width and fixed walls 3 are again fastened together, a gap is left between the fixed walls 3 and 3 and the opposite vertical edges of the side plate member 8A as seen in FIG. 14.

A pair of trough-shaped resilient stiffening plates 17 made of curved spring steel of 3 mm in thickness are placed internally of and along the opposite vertical edges of each the plate member 8A, with the convexed through portions thereof maintained resiliently in engagement with the inner surfaces of front and rear fixed walls 3 of the mold over the full length thereof, as seen in FIGS. 13 and 14.

Where a vertical type mold is used in the continuous casting machine, the opposite vertical edges of each the side plate member 8A should be made parallel and linear, rather than curved, and hence the trough-shaped resilient stiffening plates therealong should be made parallel and linear, rather than curved, unlike that shown in FIG. 13.

A frame functioning as a mold is formed by coupling a pair of side plate member 8A in an opposed relation to each other and by attaching asbestos strips 16 to the upper outer surfaces of respective side plate members in such a manner that a distance between the outer surfaces of these asbestos strips defines the width $l_2$ of a cast piece to be molded. In this connection, as tie rods 12, four steel bars of 12 mm in diameter are used. In the aforementioned frame, the opposite asbestos strips 16 are convergent toward the lower ends thereof, this presenting a funnel-shaped cross section. Since the outer surfaces of respective strips 16 define positions to which movable walls 2 and 2 are moved for reduction or increase of the width of a cast piece, then, an angle of inclination of these strips is determined in consideration with contraction due to solidification of a cast piece.

When the molds for producing a casting having a width in the range of 975 to 1350 mm is used, several kinds of tie rods different in length or variable-length spacer bolts are prepared so that the spacing between the outer surfaces of the opposite side members may be varied over a range of 5 or 10 mm depending upon the customer's demands.

A horizontal tongue piece 18 projects from the top outer surface of each anchor portion 14 of the side plate member 8A in such a manner that it is on the surface of molten steel of the existing cast piece 1 unchanged in width when the frame is inserted into the mold, so as to prevent the molten steel surface from rising. Each tongue piece 18 prevent the adverse rising of the surface of molten steel in the space defined by the movable walls 2 and the side plate members 8A, which would be caused by increase in static pressure as a result of the pouring of molten steel into the temporary mold, thereby ensuring the smooth movement of the movable walls 2. Shown at 19 is a guide piece for inserting the frame into the mold in parallel with movable walls 2 with its center aligned with the center of the mold. This guide piece is provided if desired. As locking projections 11, Y-shaped studs may be attached at a pitch of 500 mm to the side plate members.

Referring to FIG. 16, a side plate member 8'A for increasing the width of a cast piece has a lower anchor portion 14', likewise the side plate member 8A for production of a cast piece of a reduced width. The side plate members in this embodiment are identical with those in the preceding embodiment except that each strip 16' is attached to the upper outer surface of each side plate member; trough-shaped resilient stiffening plates 17 are disposed internally of and along the upper opposite side edges of each side plate members 8'A; and these members coupled by tie rods 12 into a casting mold frame.

When the frame including the side plate members 8A or 8'A is used, a gap between the side plate members and the fixed walls of the mold is closed by resilient strips 16 and trough-shaped resilient stiffening plates 17, respectively. Thus, respective strips 16 function to effectively prevent the molten steel from leaking through the aforesaid gap, which would occur upon the pouring of the molten steel into the gap between the side plate members. Furthermore, the trough-shaped resilient stiffening plates also prevent the molten steel from leaking through the aforesaid gap, which would occur when the frame is contracted by being cooled by the fiexed walls of the mold. The trough-shaped resilient stiffening plates are slidingly moved at the convex trough portions thereof, to thereby protect the joint portion between the existing cast piece and the cast piece having a changed width, which portion is likely broken out when the mold undergoes oscillation and/or a casting (or cast piece) is withdrawn from the mold.

According to the method of the present invention, a conventional, variable width casting mold is utilized as it remains intact; and a frame including a pair of the opposite side members parallel to the movable walls of the mold is inserted into the casting mold, so as to protect the coupled portion between upper and lower cast pieces from being broken out. By such arrangements, changing of width of a casting mold, for producing a casting of an increased or decreased width, is coomplished during the continuous casting operation. An existing cast piece having an unchanged width and a cast piece having a changed width are coupled together safely, easily and rapidly. The operation for changing the width of a casting mold may be conducted by remote control or may be automatically conducted if desired. A portion of a casting to be cut to discard is limited to only a portion of cast piece to which the side plate members are secured, thus providing an higher yield. Reduction of a time for changing the width of a cast piece results in reduction in a stopping interval time of the casting operation and an increase productivity, and allows the economically manufacture a lot of kinds of products from one change of a molten steel.

The method and apparatus according to the present invention has been described in conjunction with the most preferred modes of embodiments, and it will be apparent for those skilled in the art that changes and modifications of respective steps, parts and components may be made without departing the spirit of the invention and the scope of appended claims.

What we claim is:

1. For use in a method of continuous casting of a cast piece which is rectangular in cross section, the rectangular cross section having first and second parallel sides of a first length and third and fourth additional parallel sides, a frame for reducing the length of the third and fourth additional parallel sides, said frame comprising a pair of opposite side plate members each of which (a) is disposed substantially vertically and extends substantially parallel to the other side plate member, (b) has an outer surface which is spaced from the outer surface of the other side plate member by a distance equal to the desired reduced length of the third and fourth additional sides, (c) is of width in the horizontal direction substantially equal to said first length, (d) has a lower end formed with an anchor for dipping in the cast piece, and (e) has an inner surface provided with spring means of semicircular section secured thereto along each end thereof for engaging walls of a continuous casting mold.

2. A frame as defined in claim 1 further including strips of a deformable and refractory material which are applied upon the outer surfaces of said side plate members for sealing gaps between the plate members and walls of a continuous casting mold.

3. A frame as defined in claim 2 wherein the strips are of asbestos.

4. In combination, a frame as defined in claim 1 and a continuous casting mold having two fixed walls which are parallel to each other and are spaced apart by a distance equal to said first length and two relatively movable walls which are parallel to each other and are disposed between said fixed walls, said frame being positionable in the cavity defined by said walls with each of said plate members extending parallel to the movable walls and perpendicular to the fixed walls.

5. A combination as defined in claim 4 wherein the frame further includes strips of a deformable and refractory material which are applied upon the outer surfaces of said plate members and are of a width to seal gaps between the plate members and said fixed walls.

6. For use in a method of continuous casting of a cast piece which is rectangular in cross section, the rectangular cross section having first and second parallel sides of a first length and third and fourth parallel sides, a frame for increasing the length of the third and fourth additional parallel sides, said frame comprising a pair of opposite side plate members each of which (a) consists of an upper portion and a lower portion, said upper portion being disposed substantially vertically and extending substantially parallel to the upper portion of the other plate member and having an outer surface which is spaced from the outer surface of the other side plate member by a distance equal to the desired increased length of the third and fourth additional sides, and said lower portion having an outer surface which is spaced from the outer surface of the lower portion of the other side plate member by a distance not greater than the existing length of the third and fourth additional parallel sides, (b) is of width in the horizontal direction substantially equal to said first length, and (c) has a lower end formed with an anchor for dipping in the cast piece and spaced from the anchor of the other side plate member by a distance less than the existing length of said third and fourth parallel sides.

7. A frame as defined in claim 6 further including strips of a deformable and refractory material which are applied upon the outer surfaces of said side plate members for sealing gaps between the plate members and walls of a continuous casting mold.

8. A frame as defined in claim 7 wherein the strips are of asbestos.

9. A frame as defined in claim 6 wherein each side plate member has an inner surface and a spring means having a semicircular section is secured to the inner surface of each side plate member along each end thereof for engaging walls of a continuous casting mold.

10. A frame as defined in claim 6 wherein a spring means projects from the outer surface of each side plate member for engaging a wall of a continuous casting mold.

11. In combination, a frame as defined in claim 6 and a continuous casting mold having two fixed walls which are parallel to each other and are spaced apart by a distance equal to said first length and two relatively movable walls which are parallel to each and are disposed between said fixed walls, said frame being positionable with said lower portion of each plate in the cavity defined by said walls with the upper portion of each plate member extending parallel to the movable walls and perpendicular to the fixed walls.

12. A combination as defined in claim 11 wherein the frame further includes strips of a deformable and refractory material which are applied upon the outer surfaces of said side plate members and are of a width to seal gaps between the plate members and said fixed walls.

13. A combination as defined in claim 11 wherein each plate member has an inner surface and a spring means having a semicircular section is secured to the inner surface of each side plate member along each end thereof for supporting the plate members slidably against said fixed walls.

14. A combination as defined in claim 11 wherein the frame includes a spring means projecting from the outer surface of each side plate member for engaging the movable walls.

* * * * *